US007477198B2

(12) United States Patent
Kanazawa et al.

(10) Patent No.: US 7,477,198 B2
(45) Date of Patent: Jan. 13, 2009

(54) ANTENNA APPARATUS AND RADIO COMMUNICATION APPARATUS

(75) Inventors: Masaru Kanazawa, Kawasaki (JP); Shin Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/439,462

(22) Filed: May 23, 2006

(65) Prior Publication Data

US 2007/0188392 A1 Aug. 16, 2007

(30) Foreign Application Priority Data

Feb. 15, 2006 (JP) ..... 2006-037404

(51) Int. Cl.
*H01Q 1/24* (2006.01)

(52) U.S. Cl. ..... 343/702; 343/833; 343/834

(58) Field of Classification Search ..... 343/876, 343/702, 700 MS, 846, 833, 834, 815, 817, 343/818
See application file for complete search history.

(56) References Cited

U.S. PATENT DOCUMENTS

| | | | | |
|---|---|---|---|---|
| 5,293,172 | A * | 3/1994 | Lamberty et al. | 343/701 |
| 6,392,610 | B1 * | 5/2002 | Braun et al. | 343/876 |
| 6,762,724 | B2 | 7/2004 | Peng | |
| 6,781,556 | B2 | 8/2004 | Kojima et al. | |
| 2004/0085251 | A1 * | 5/2004 | Shimura | 343/872 |
| 2006/0017624 | A1 | 1/2006 | Nagano et al. | |
| 2006/0262015 | A1 * | 11/2006 | Thornell-Pers et al. | 343/702 |

FOREIGN PATENT DOCUMENTS

| | | |
|---|---|---|
| JP | 10-084406 | 3/1998 |
| JP | 10-190344 | 7/1998 |
| JP | 10-190347 | 7/1998 |
| JP | 2004-128557 | 4/2004 |
| JP | 2004-304705 | 10/2004 |

OTHER PUBLICATIONS

United States Office Action dated Jul. 5, 2007, from corresponding U.S. Appl. No. 11/642,268.

* cited by examiner

*Primary Examiner*—Hoang V Nguyen
(74) *Attorney, Agent, or Firm*—Katten Muchin Rosenman LLP

(57) ABSTRACT

The present invention relates to an antenna apparatus corresponding to a plurality of multi-bands, etc. and makes a plurality of radio communication frequencies easily changed or set. The present invention includes a passive element composed of a plurality of element units (elements 141, 142, 143) linked with a switching element (PIN diode) between the element units, and since the operating frequency of the passive element is switched by opening and closing the switching element and the passive element acts as a waveguide element, a radiation pattern can be acquired by the passive element and the effect of a human body is reduced on the radiant efficiency.

19 Claims, 23 Drawing Sheets

ANTENNA APPARATUS AND RADIO COMMUNICATION APPARATUS

CROSS-REFERENCE TO RELATED APPLICATIONS

This application is based upon and claims the benefit of priority from the prior Japanese Patent Application No. 2006-037404, filed on Feb. 15, 2006, the entire contents of which are incorporated herein by reference.

BACKGROUND OF THE INVENTION

1. Field of the Invention

The present invention relates generally to an antenna corresponding to a plurality of radio communication frequencies, and more particularly, to an antenna apparatus and a radio communication apparatus including a passive element preferred for various radio communications such as a folding cellular phone.

2. Description of the Related Art

In a mobile telephone service such as a cellular phone, radio communication frequencies are increased and made multiband such as dual-band or triple-band as a coverage area is expanded, and an antenna corresponding to such frequencies is needed.

A radiant efficiency is an evaluation item of antenna characteristic and is improved relatively easily by a distance between an antenna and ground (GND) or by a matching circuit. Since a cellular phone is generally used by bring a receiver into contact with ear and the antenna comes closer to a human head, radiated electric waves are attenuated by the effect of a human body in no small way. As the extent of the attenuation of the radiated electric waves is increased, the radio communication may be disturbed. Since a plurality of resonance points exists in one antenna in the case of a multiband antenna, the radiant efficiency tends to be inferior to a single-band antenna.

Such an antenna apparatus with a plurality of resonance points includes Japanese Patent Application Laid-Open Publication Nos. 1998-190347, 1998-190344, 2004-304705, 2004-128557, etc.; Japanese Patent Application Laid-Open Publication No. 1998-190347 discloses a patch antenna apparatus corresponding to a plurality of frequencies, which is provided with a plurality of additional patch units connected by a PIN diode on a patch unit and which makes the PIN diode conductive and nonconductive to switch connection of the patch unit and the additional patch units; Japanese Patent Application Laid-Open Publication No. 1998-190344 discloses an antenna with a feed element and a passive element connected by a switching element, which changes a resonance frequency by opening and closing the switching element; Japanese Patent Application Laid-Open Publication No. 2004-304705 discloses a radio apparatus including a slot electromagnetically coupled to an antenna as well as a switch for shorting or opening a bottom board region of the slot, which switches radiation patterns of the antenna by opening and closing the switch; and Japanese Patent Application Laid-Open Publication No. 2004-128557 discloses an antenna including first and second antennas on a printed board, which changes electric length of the antennas to switch directional characteristics.

By the way, in a radio communication apparatus, such as a cellular phone, coming closer to a human body at the time of communication, since the radiated electric waves of the antenna are affected by a human body in no small way and the effect thereof cannot be eliminated completely, an antenna apparatus corresponding to the multiband is needed. That is, an antenna apparatus is requested which enhances the radiant efficiency, which reduces the effect of a human body, and which is suitable for the multiband.

Japanese Patent Application Laid-Open Publication Nos. 1998-190347, 1998-190344, 2004-304705, and 2004-128557 do not disclose or indicate such problems and do not disclose or include a concept of an antenna apparatus that solves the problems.

SUMMARY OF THE INVENTION

A first object of the present invention relates to an antenna apparatus corresponding to a plurality of multi-bands and is to make a plurality of radio communication frequencies easily changed or set.

A second object of the present invention is to reduce the effect of a human body on the radiant efficiency.

To achieve the above objects, the present invention includes a passive element composed of a plurality of element units linked with a switching element between the element units, and since the operating frequency of the passive element is switched by opening and closing the switching element and the passive element acts as a waveguide element, a radiation pattern can be acquired by the passive element and the effect of a human body is reduced on the radiant efficiency.

To achieve the above objects, a first aspect of the present invention provides an antenna apparatus, and the antenna apparatus includes a passive element having a plurality of element units, which is disposed in proximity to a feeding-side element, and a switching element linking the element units of the passive element, and can switch the operating frequency of the passive element by opening and closing the switching element.

According to such a configuration, the element units linked by the switching element therebetween are switched by opening and closing the switching element, and the length of the passive element is changed by the linked element units to switch the operating frequency. With such a configuration, the first object is achieved.

To achieve the above objects, in the antenna apparatus, the passive element is disposed at the end of the feeding element and couples with the feeding element to constitute a waveguide element. According to such a configuration, along with the shifting of the operating frequency, an electric wave radiation zone can be shifted toward the passive element.

To achieve the above objects, in the antenna apparatus, the passive element may include a control terminal that applies a control signal for opening and closing the switching element. The antenna apparatus may comprise a control terminal that applies a control signal for opening and closing the switching element; and an inductor that is inserted between the control terminal and the passive element.

To achieve the above objects, in the antenna apparatus, preferably, a ground conductor plate may be disposed toward the non-radiation surface for the passive element. According to such a configuration, selectivity of the radiation surface can be achieved by disposing the ground conductor plate.

To achieve the above objects, the element units of the passive element may be connected to the circuit substrate via elastic contacts.

To achieve the above objects, a second aspect of the present invention provides a radio communication apparatus, and the radio communication apparatus includes a passive element having a plurality of element units, which is disposed in proximity to a feeding-side element, and a switching element linking the element units of the passive element, and can switch the operating frequency of the passive element by opening and closing the switching element.

According to the radio communication apparatus with such a configuration, the element units linked by the switching element therebetween are switched by opening and closing the switching element, and the length of the passive element is changed by the linked element units to switch the operating frequency and to enable multiband radio communication. With such a configuration, the first object is also achieved.

To achieve the above objects, the radio communication apparatus may comprise a control terminal that applies a control signal for opening and closing the switching element; and a controlling unit that applies the control signal to the control terminal to perform control for making the switching element conductive or nonconductive. The radio communication apparatus may comprise a control terminal that applies a control signal for opening and closing the switching element; and an inductor that is inserted between the control terminal and the passive element. In the radio communication apparatus, the passive element may include an element unit grounded. The passive element may be constituted by a plurality of conductor patterns formed on a circuit substrate. According to such a configuration, the conductor patterns constitute the element units with desired widths and lengths. The passive element may be divided into a plurality of the element units and be formed by linking each element unit with the switching element. The passive element may be provided with a predetermined space for including a ground conductor. A ground conductor plate may be disposed toward the non-radiation surface for the passive element. The switching element may be a semiconductor device. The passive element may be a chip antenna. The element units of the passive element may be connected to the circuit substrate via elastic contacts. The passive element may be formed by establishing a predetermined space between the element units and by inserting a semiconductor device for linking the element units in each space. The ground conductor plate may be a casing unit of the radio communication apparatus or a circuit substrate built into the radio communication apparatus.

The features and advantages of the present invention are listed as follows.

(1) The element units constituting the passive element can be selected by opening and closing the switching element to correspond to a plurality of radio communication frequencies.

(2) Since the passive element is also provided with the ground conductor to establish selectivity of the radiation surface, the effect of a human body, etc. can be avoided because of the selectivity.

BRIEF DESCRIPTION OF THE DRAWINGS

Other objects, features, and advantages of the present invention will become more apparent from the following detailed description of the presently preferred embodiments thereof when taken in conjunction with the accompanying drawings, in which.

DETAILED DESCRIPTION OF THE PREFERRED EMBODIMENTS

First Embodiment

Figure 1:
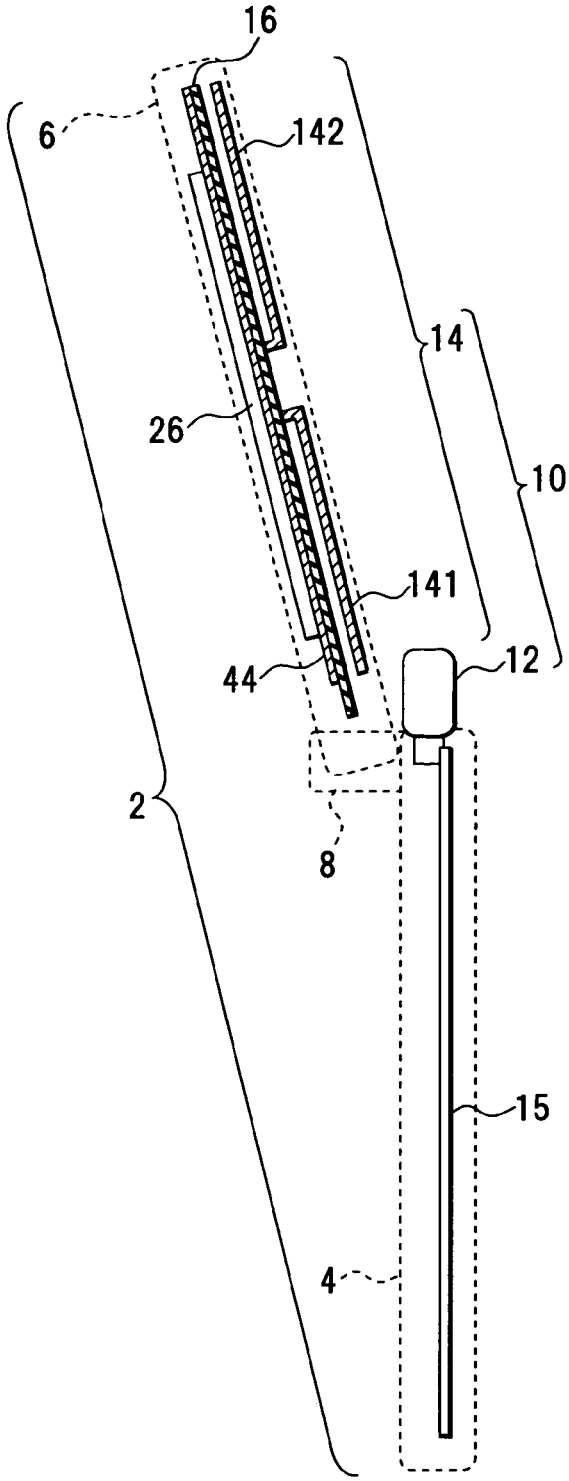
FIG. 1 is a cross-section diagram of an antenna apparatus portion of a cellular phone according to a first embodiment.
Figure 2:
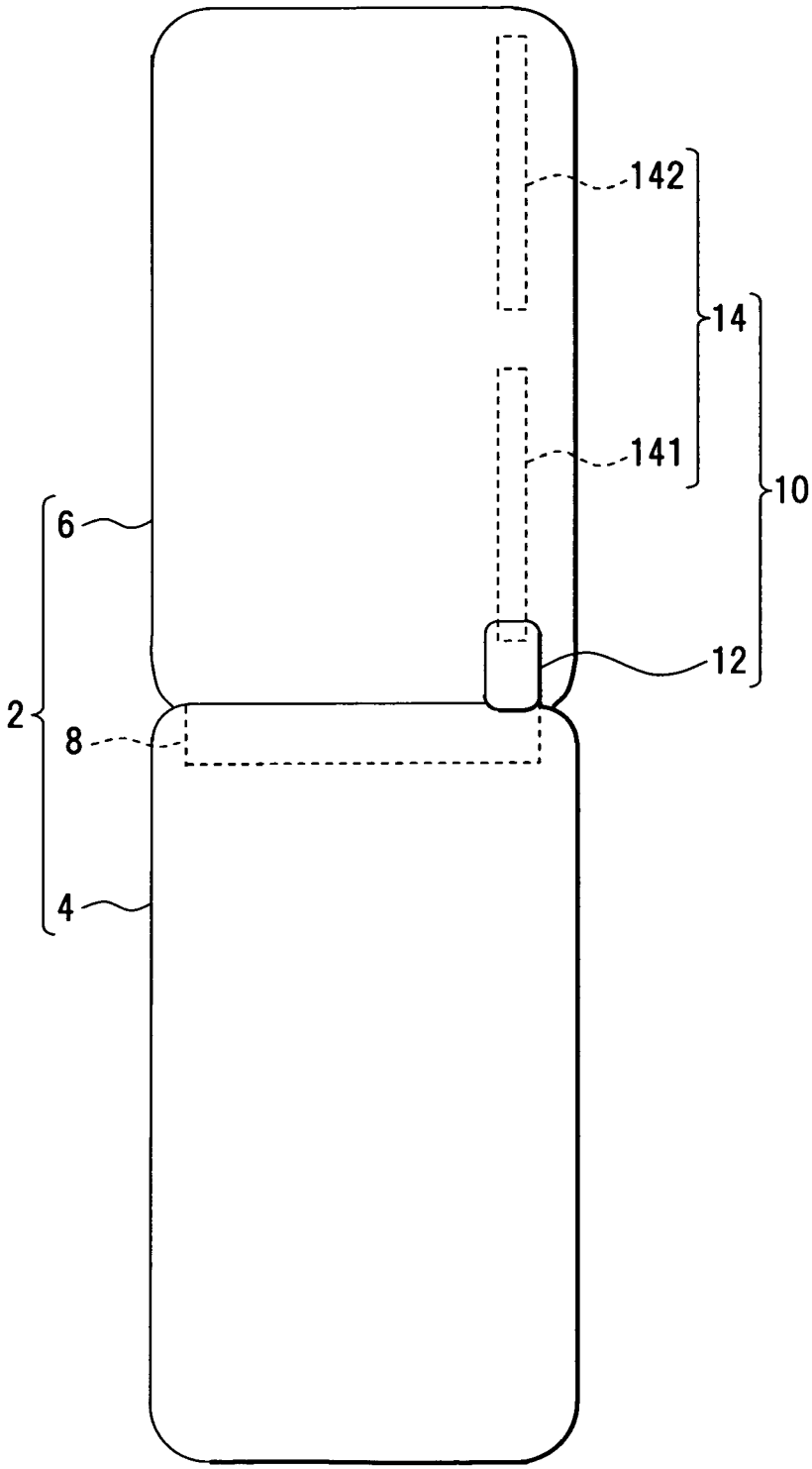
FIG. 2 shows a rear side of the cellular phone.
Figure 3:
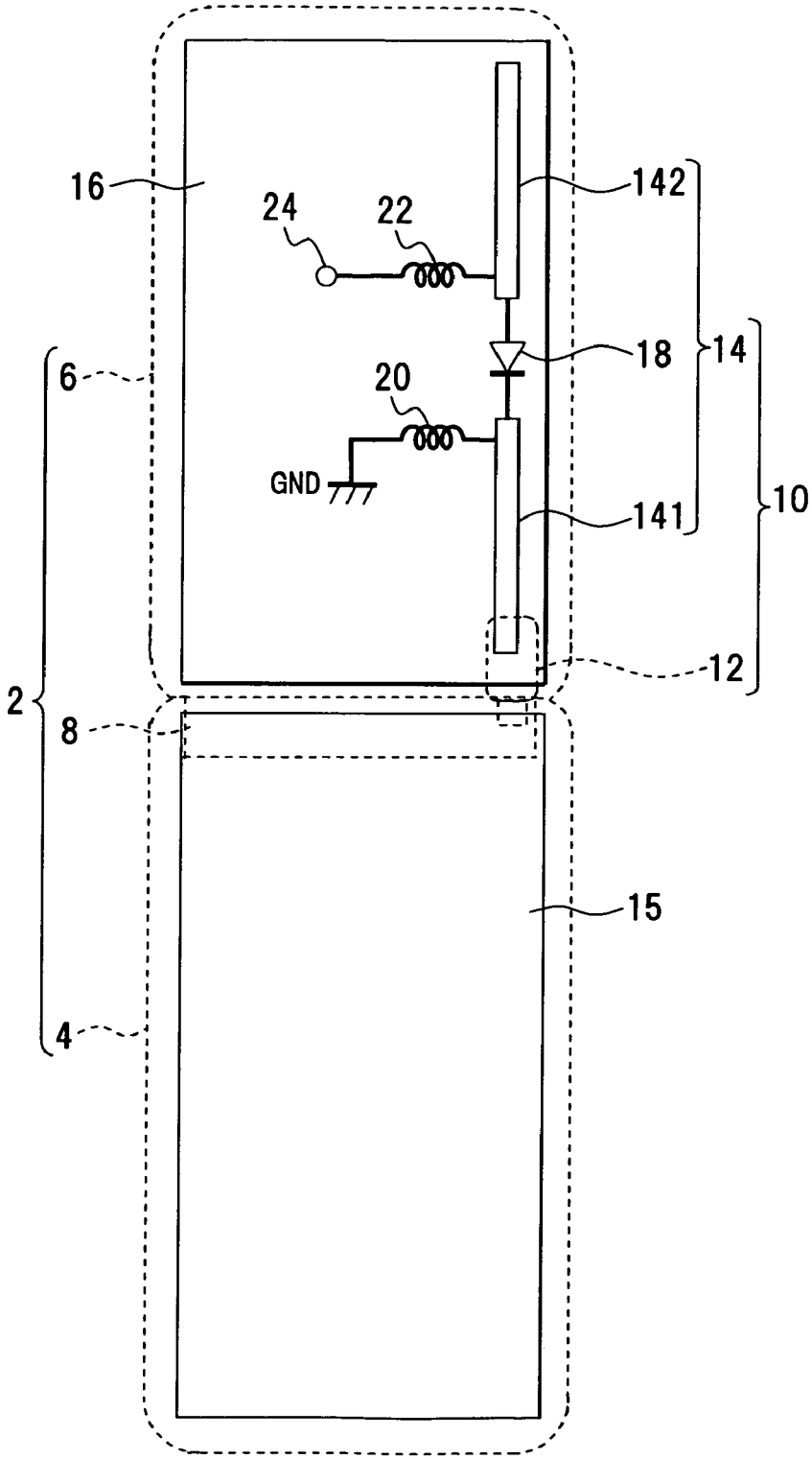
FIG. 3 shows a configuration example of the antenna apparatus of the cellular phone.
Figure 4:
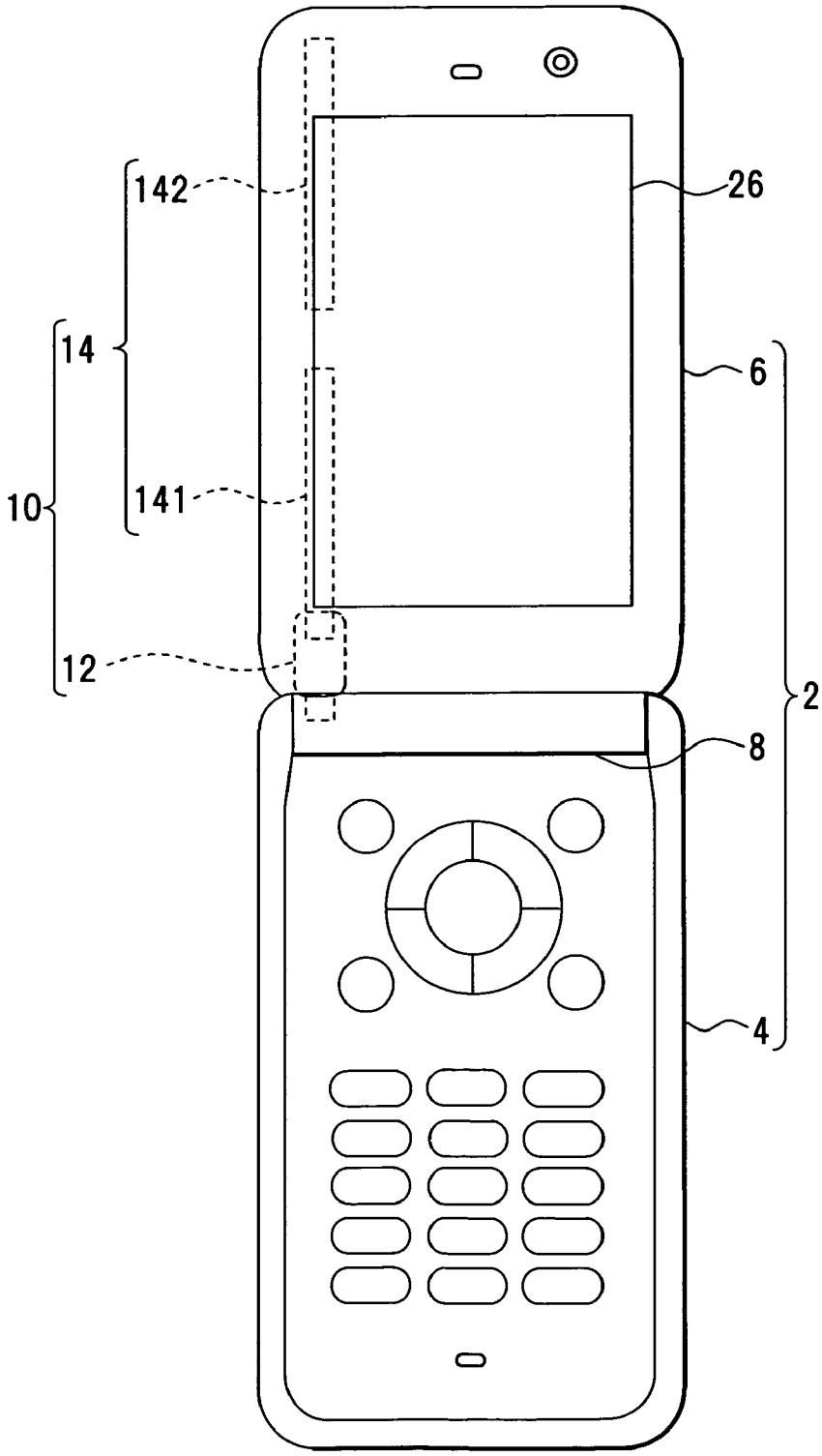
FIG. 4 shows a front side of the cellular phone.

A first embodiment of the present invention will be described with reference to FIGS. 1, 2, 3, and 4. FIG. 1 is a cross-section diagram of an antenna apparatus portion of a cellular phone; FIG. 2 shows a rear side of the cellular phone; FIG. 3 shows a configuration example of the antenna apparatus of the cellular phone; and FIG. 4 shows a front side of the cellular phone.

A cellular phone 2 is an example of a radio communication apparatus using a plurality of radio communication frequencies and, in the cellular phone 2 of this embodiment, a first casing unit 4 and a second casing unit 6 are coupled by a hinge unit 8 such that the casing units 4, 6 can be opened and closed. Each casing unit 4, 6 may be made of a conducting material such as metal or may be made of an insulating material such as synthetic resin.

The cellular phone 2 is provided with an antenna apparatus 10 for multiband, and the antenna apparatus 10 includes a main antenna 12 that is a feeding element to which electric power is supplied, and a passive element 14 that is a sub-antenna coupled to the main antenna 12 without power feeding. The main antenna 12 is disposed in the casing unit 4 and connected to a circuit substrate 15 built into the casing unit 4. In this case, the main antenna 12 is located such that the main antenna 12 is projected from the casing unit 4 and overlapped with a portion of the rear face of the opened casing unit 6, i.e., a portion of the passive element 14. The circuit substrate 15 is equipped with a radio communicating unit and controlling unit not shown.

The passive element 14 is disposed in the casing unit 6 and is constituted by a plurality of element units, for example, elements 141, 142 in a divided manner, and an element length is on the order of λ/2 relative to a wavelength λ of a radio communication frequency. The opposite ends of the respective elements 141, 142 are connected to a circuit substrate 16 built into the casing unit 6, and a PIN diode 18 (FIG. 3) is connected as a switching element between the elements 141, 142. The passive element 14 constitutes a serial circuit of the element 141, the PIN diode 18, and the element 142. Each element 141, 142 may be constituted by a conductor pattern portion formed on the circuit substrate 16, for example, and may be constituted by a conductor other than the circuit substrate 16. When the casing unit 6 is made of an insulating material, each element 141, 142 may be constituted by a conductor pattern disposed on the inside or outside of the casing unit 6. The PIN diode 18 is mounted on the circuit substrate 16, and the cathode and anode thereof are connected to the element 141 and the element 142, respectively.

A choke coil 20 is connected as an inductor between the element 141 and a ground point (GND), and the element 142 is connected to one end of a choke coil 22, which is another inductor, with a voltage application terminal 24 formed at the other end. Between the voltage application terminal 24 and the ground point, a voltage VC is applied which is a control signal for switching the PIN diode 18. The choke coils 20, 22 are mounted on the circuit substrate 16 and, in such a case, one end of the choke coil 20 may be connected to a ground conductor (GND) mounted on the circuit substrate 16.

The circuit substrate 16 is provided with a ground conductor 44, LCD (Liquid Crystal Display), etc. and a displaying unit 26 is formed in the front face of the casing unit 6, as shown in FIG. 4.

Figure 5:
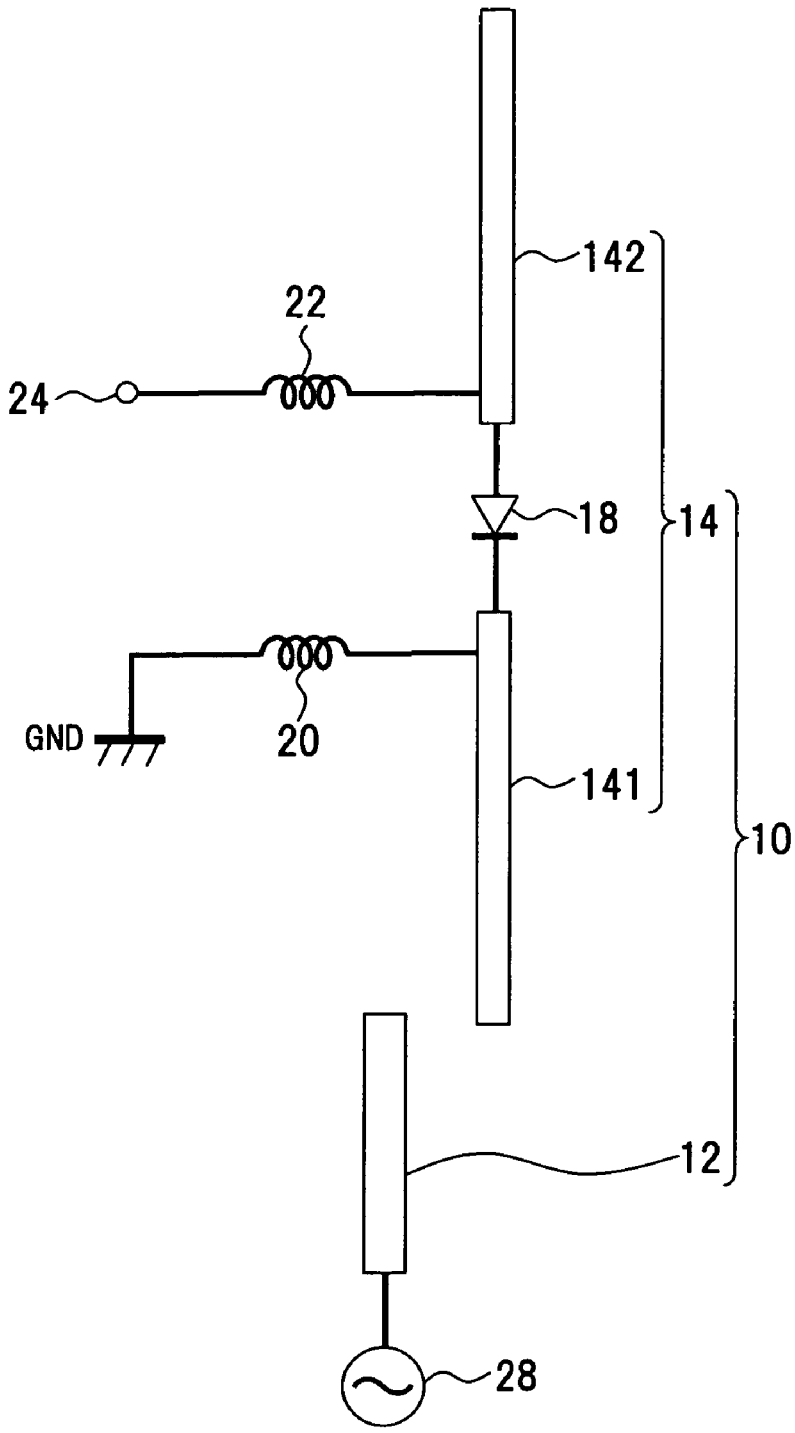
FIG. 5 shows a configuration example of the antenna apparatus.
Figure 6:
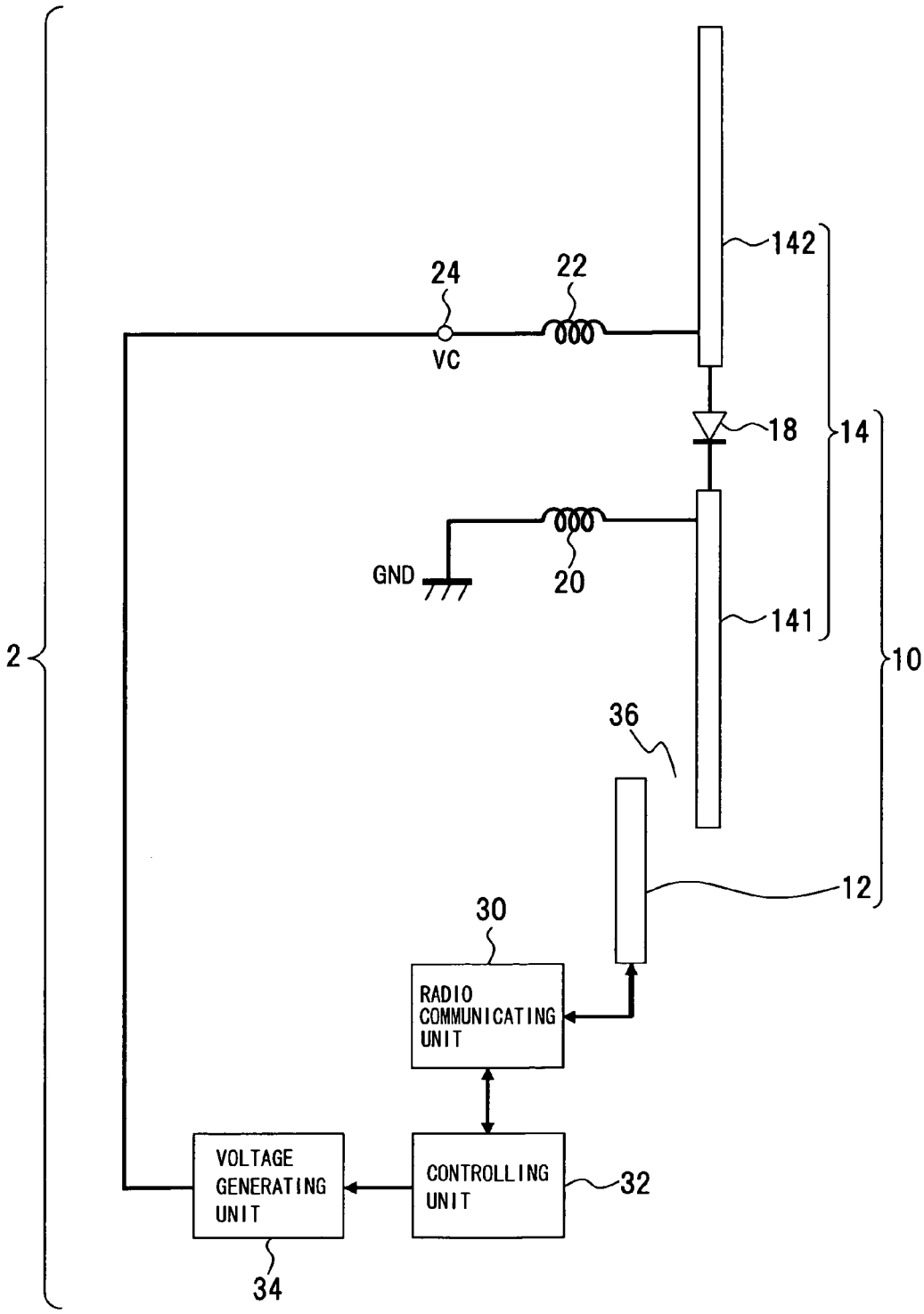
FIG. 6 shows a configuration example of the cellular phone including the antenna apparatus.
Figure 7A:
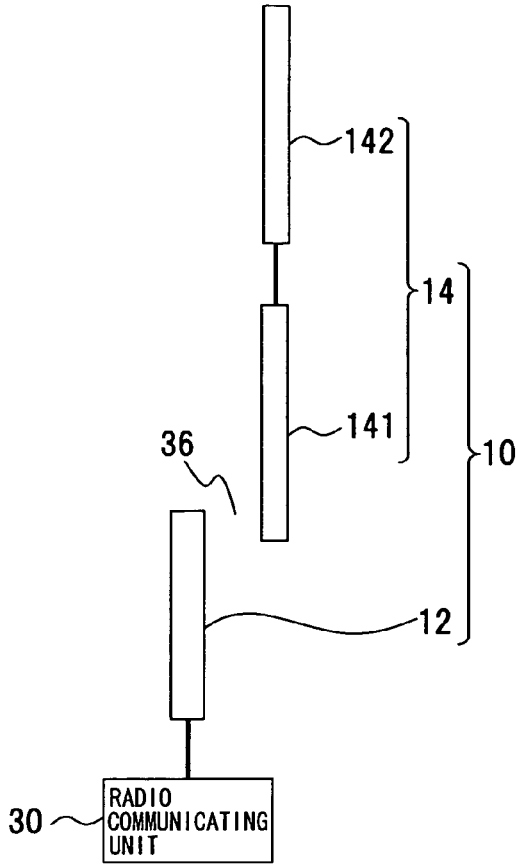
FIGS. 7A and 7B show switch-over of a resonance frequency of a passive element.
Figure 7B:
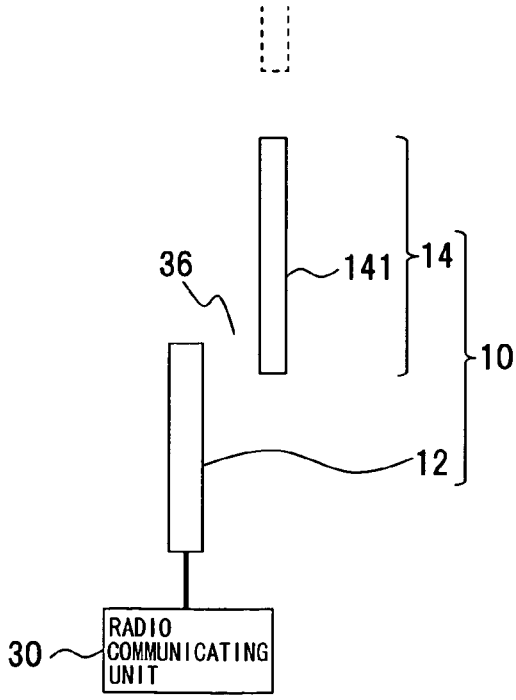
Figure 8:
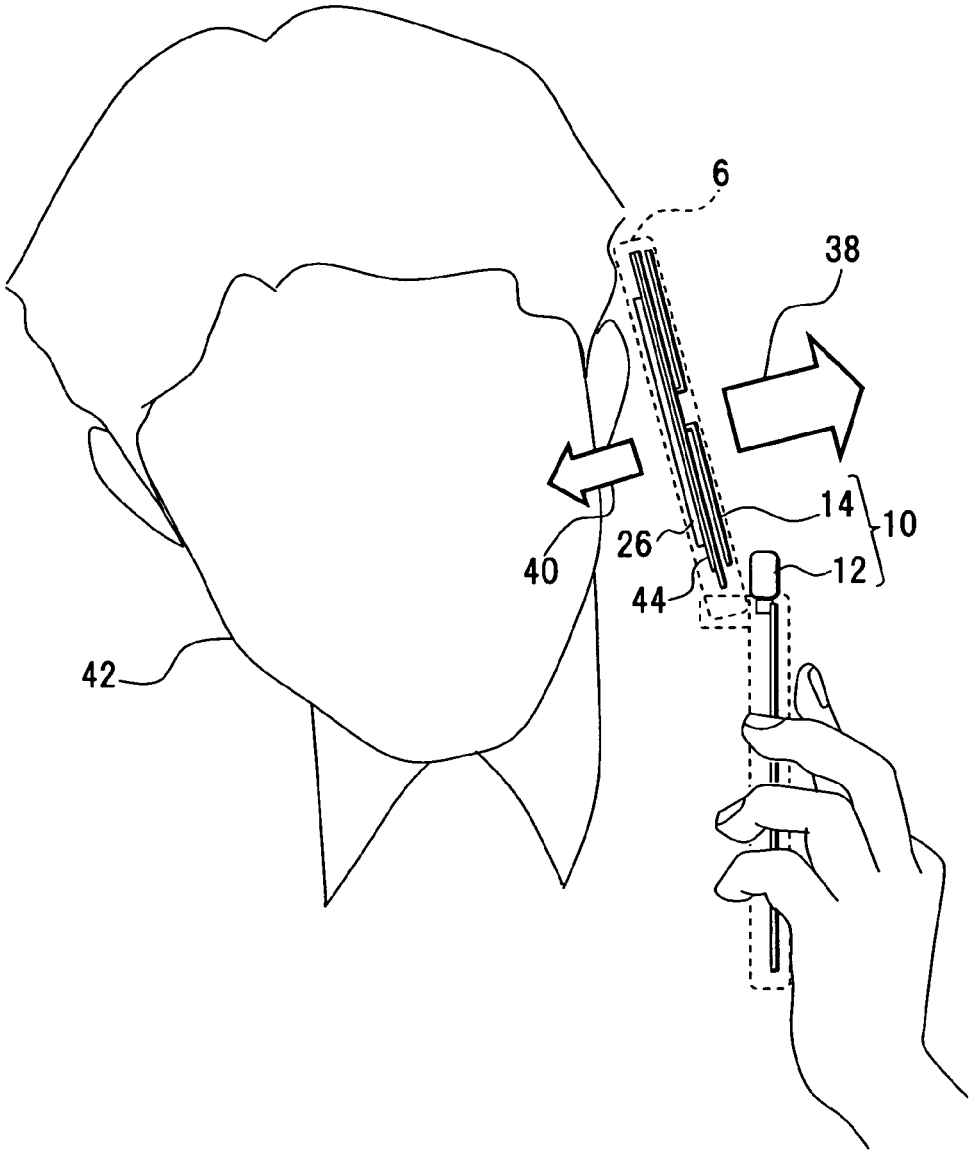
FIG. 8 shows radiation from the antenna apparatus.

The antenna apparatus 10 will be described with reference to FIGS. 5, 6, 7A, 7B, and 8. FIG. 5 shows a configuration example of the antenna apparatus; FIG. 6 shows a configuration example of the cellular phone 2 including the antenna apparatus 10; FIGS. 7A and 7B show switch-over of a resonance frequency of the passive element; and FIG. 8 shows radiation from the antenna apparatus 10. In FIGS. 5, 6, 7A, and 7B, the same numerals are added to the same portions as FIGS. 1 to 4.

The antenna apparatus 10 is configured as shown in FIG. 5 and the main antenna 12 is connected to a feeding point 28. Therefore, in the cellular phone 2, as shown in FIG. 6, the main antenna 12 of the antenna apparatus 10 is connected to a radio communicating unit 30, which is a feeding point, and the radio communicating unit 30 is connected to a controlling unit 32 that performs the switching control for the PIN diode 18 and the phone-call control. The controlling unit 32 is connected to a voltage generating unit 34 that generates a control voltage. The voltage generating unit 34 generates the voltage VC depending on the selection of the radio communication frequency and the voltage VC is applied to the voltage application terminal 24.

If a positive voltage VC exceeding a forward voltage $V_F$ of the PIN diode 18 ($VC \geqq V_F$) is added to the voltage application terminal 24, the PIN diode 18 becomes conductive and, as shown in FIG. 7A, the passive element 14 is constituted by the linked elements 141, 142. If the PIN diode 18 is not conductive, as shown in FIG. 7B, the element 142 is separated from the element 141 and the passive element 14 is constituted only by the element 141.

By the way, in the antenna apparatus 10, the choke coils 20, 22 are provided in a circuit for making the PIN diode conductive or nonconductive, and when it is assumed that the choke coils 20, 22 have inductances L1, L2 and impedances Z1, Z2:

$$Z1=2_{\pi}fL1 \quad (1)$$

$$Z2=2_{\pi}fL2 \quad (2)$$

and the impedances Z1, Z2 are increased in proportion to a frequency f, and if each impedance Z1, Z2 is increased to the extent that can be considered as an insulator at the resonance frequency f1, f2 of the antenna apparatus 10, the power feeding system of the antenna apparatus 10 and the voltage generating unit 34 can be separated and insulated in an alternating current environment. That is, the choke coils 20, 22 constitute separating and insulating means for the radio communicating unit 30 and the voltage generating unit 34. The direct-current resistance of the choke coil 20, 22 is vanishingly small and has no effect on the voltage VC, which is a direct-current voltage for making the PIN diode 18 conductive.

The element 141 of the passive element 14 is coupled via space 36 to the main antenna 12, which is a feeding element; in the case of FIG. 7A, the antenna apparatus 10 is constituted by the main antenna 12 and the passive elements 141, 142; and in the case of FIG. 7B, the antenna apparatus 10 is constituted by the main antenna 12 and the passive element 141.

Since the resonance wavelength of the overall antenna apparatus 10 is λ/2, if the resonance frequency f1 of the elements 141, 142 of the passive element 14 is, for example, 800 [MHz] and if the resonance frequency f2 of the element 141 is, for example, 2 [GHz], the operating frequency of the passive element 14 can be switched from 800 [MHz] to 2 [GHz] by switching the PIN diode 18 from a conductive state to a nonconductive state.

In the cellular phone 2 including such an antenna apparatus 10, the switch-over of the resonance frequencies f1, f2 of the passive element 14 may be operated in conjunction with the selection of the transmission frequency of the cellular phone 2; when the radio communicating unit 30 is operated at the resonance frequency f1, for example, a 800 [MHz] band, the voltage VC may be supplied from the voltage generating unit 34 to the voltage application terminal 24; and when the radio communicating unit 30 is operated at the resonance frequency f2, for example, a 2 [GHz] band, the voltage VC may be canceled to establish VC=0. In this way, the resonance frequency of the passive element 14 is switched in accordance with the transmission frequency; the operating frequencies of the elements 141, 142 are changed automatically depending on the transmission frequency; and radiation patterns of electromagnetic waves 38, 40 can be acquired also in the passive element 14 as shown in FIG. 8.

The passive element 14 is disposed on the rear side of the casing unit 6 of the cellular phone 2 and is coupled to the main antenna 12 to act as a waveguide element of the main antenna 12. Since the ground conductor 44 and the displaying unit 26 are formed on the circuit substrate 16, the radiation toward a human body 42 is small; the radiation becomes larger in the direction opposite to the human body 42 (on the rear side of the casing unit); and the radiation is constrained in the direction toward the human body 42 (on the front side of the casing unit 6). That is, since the passive element 14 is disposed on the rear side of the casing unit 6 and the ground conductor 44 is located at a portion of the casing unit 6 of the cellular phone 2 coming closer to the human body 42, the reduction can be achieved in the effect of the human body 42 on the radiated electromagnetic waves, such as the absorption of the electromagnetic waves by the human body. Since the passive element 14 is included, by switching the elements 141, 142 thereof, the antenna apparatus 10 can be made correspond to the multiband and an optimum radiant efficiency can be achieved in the antenna apparatus 10 depending on the radio communication frequency.

Second Embodiment

Figure 9:
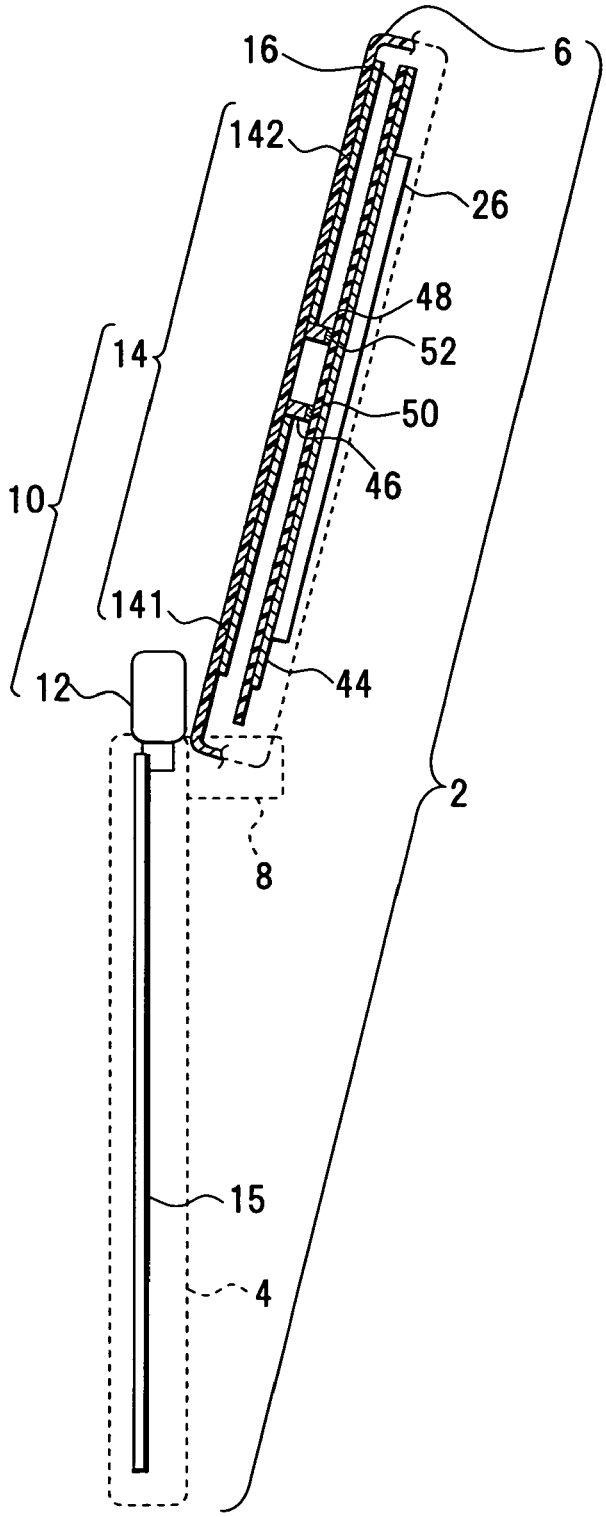
FIG. 9 is a cross-section diagram of a configuration example of an antenna apparatus and a cellular phone including a passive element in a casing unit according to a second embodiment.
Figure 10:
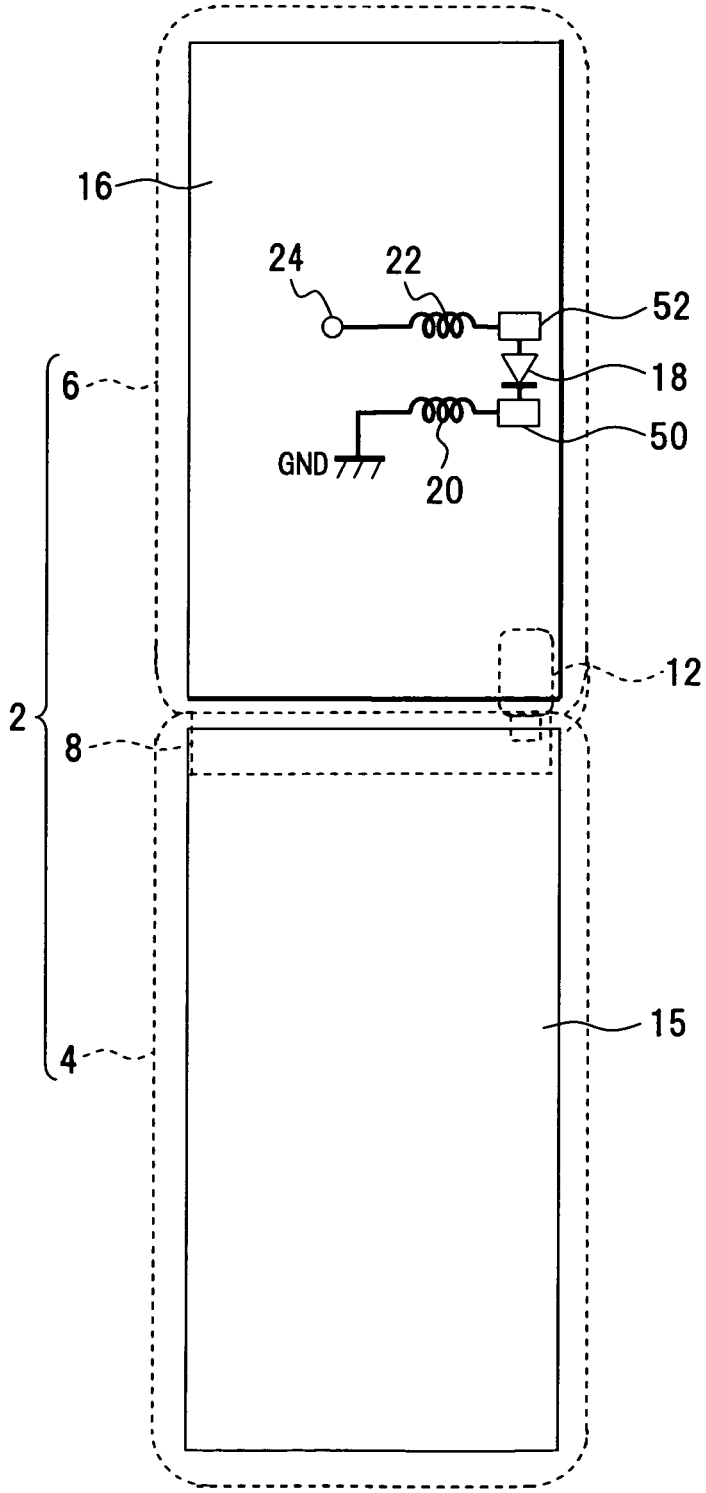
FIG. 10 shows a configuration example of the cellular phone.
Figure 11A:
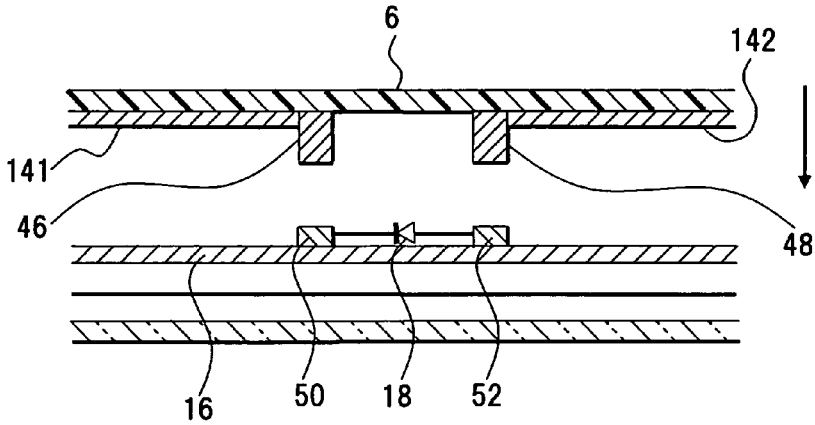
FIGS. 11A and 11B show connection between the passive element and a circuit substrate.
Figure 11B:
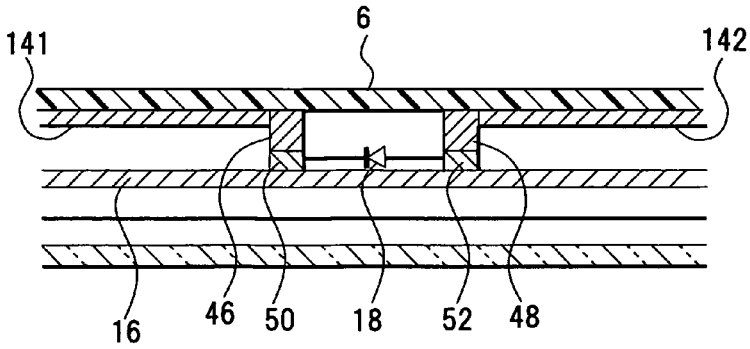

A second embodiment of the present invention will be described with reference to FIGS. 9, 10, 11A, and 11B. FIG. 9 is a cross-section diagram of a configuration example of an antenna apparatus and a cellular phone including a passive element in a casing unit; FIG. 10 shows a configuration example of the cellular phone; and FIGS. 11A and 11B show connection between the passive element and a circuit substrate. In FIGS. 9 to 11B, the same numerals are added to the same portions as FIGS. 1 to 8.

In this cellular phone 2, the elements 141, 142 of the passive element 14 are disposed within the rear side of the casing unit 6, and the casing unit 6 is provided with elastic contacts 46, 48 connected to the opposite ends of the elements 141, 142. The circuit substrate 16 is disposed in the casing unit 6 and is provided with contact portions 50, 52 corresponding to the elastic contacts 46, 48.

As shown in FIG. 10, the PIN diode 18 is disposed between the contact portions 50, 52 of the circuit substrate 16; the contact portion 50 is connected to the cathode of the PIN diode 18 and is connected via the choke coil 20 to the ground point; the contact portion 52 is connected to the anode of the PIN diode 18; and the voltage application terminal 24 is formed via the choke coil 22 for the contact portion 52. The choke coils 20, 22 are mounted on the circuit substrate 16.

In such a configuration, when assembling the cellular phone 2, because of the elasticity of each elastic contact 46, 48, the elastic contacts 46, 48 of the passive element 14 mounted in the casing unit 6 are shifted from a state shown in FIG. 11A to a state shown in FIG. 11B and are applied to the contact portions 50, 52 of the circuit substrate 16 to acquire the connection therebetween. As a result, the PIN diode 18 of the circuit substrate 16 is connected between the elements 141, 142 of the passive element 14; the element 141 is connected via the choke coil 20 to the ground point of the circuit substrate 16; and the element 142 is connected via the choke coil 22 to the voltage application terminal 24.

Therefore, since the passive element 14 is disposed on the rear side of the casing unit 6 of the antenna apparatus 10 and the cellular phone 2 with such a connection form, efficient electromagnetic wave radiation can be acquired from the rear side of the cellular phone 2 and the reduction can be achieved in the human body's absorption of the radiated electromagnetic waves from the antenna apparatus 10. Since the resonance frequency of the passive element 14 is switched in accordance with the transmission frequency, the operating frequency of the elements 141, 142 can be set automatically depending on the transmission frequency and the performance of the multiband antenna can be improved as is the case with the aforementioned embodiment.

Since the passive element 14 is disposed within the casing unit 6 and is away from the front side of the casing unit 6, the passive element 14 of the cellular phone 12 is away from the human body at the time of a phone call correspondingly, and the effect of the human body on the radiated electromagnetic waves can be reduced.

Third Embodiment

Figure 12:
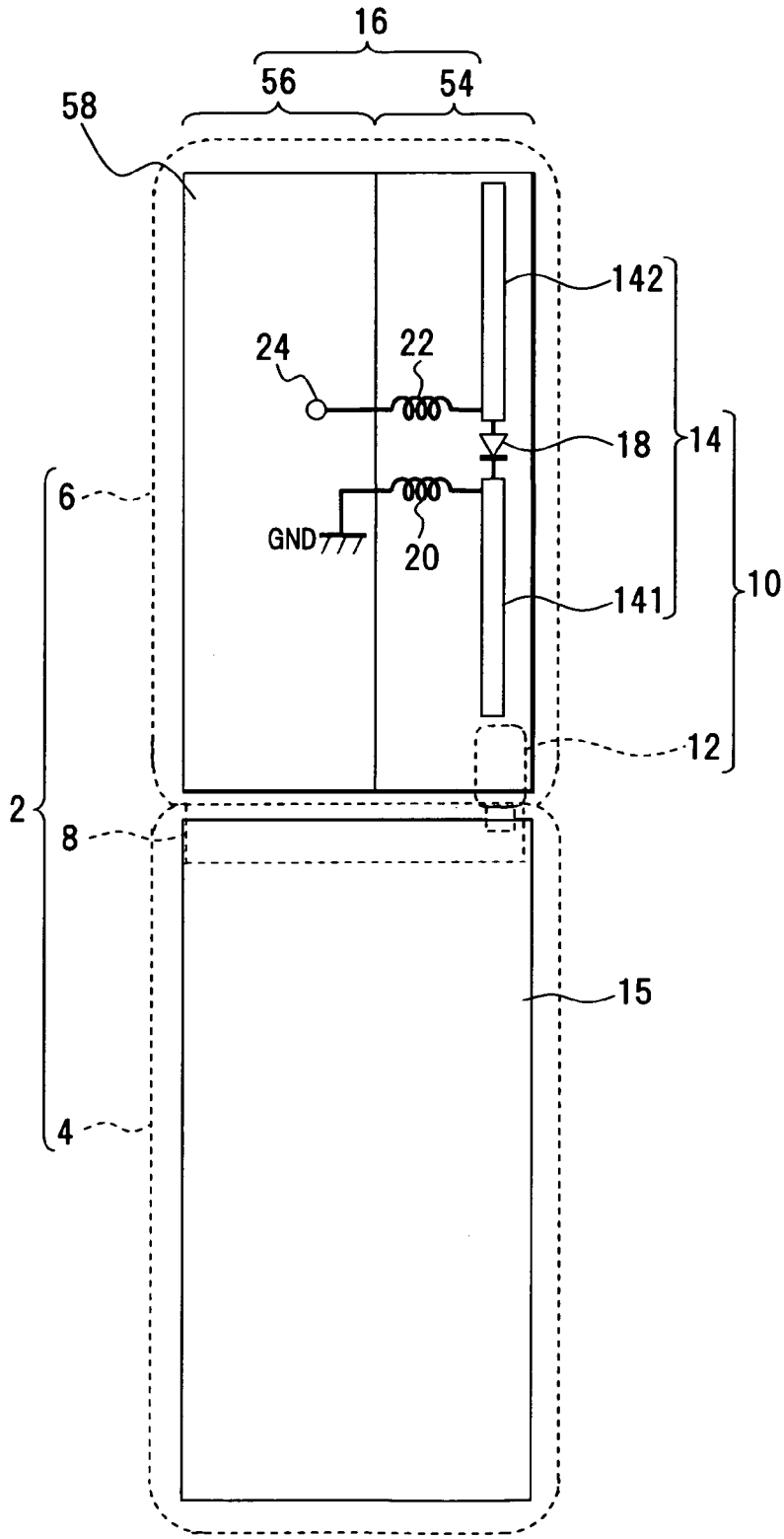
FIG. 12 shows a mounting form of a passive element of a cellular phone according to a third embodiment.
Figure 13:
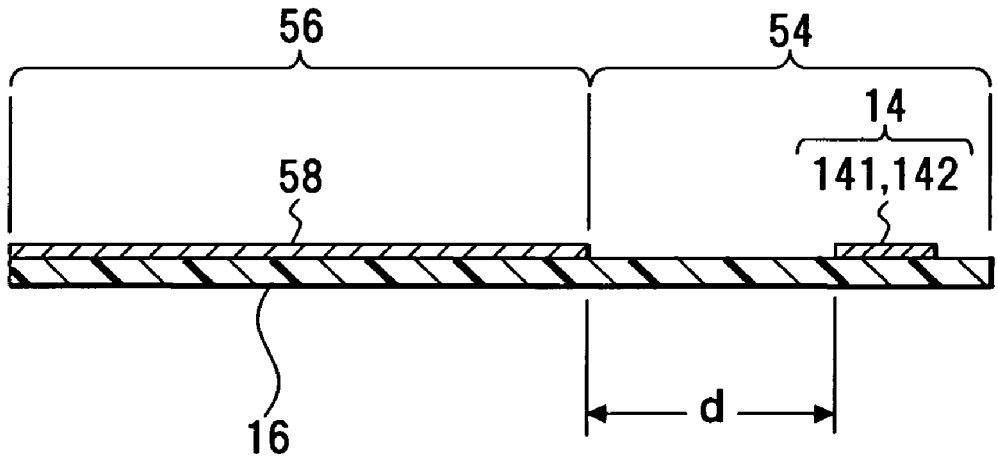
FIG. 13 is a cross-section diagram of a passive element portion.

A Third embodiment of the present invention will be described with reference to FIGS. 12 and 13. FIG. 12 shows a mounting form of a passive element of a cellular phone and FIG. 13 is a cross-section diagram of a passive element portion. In FIGS. 12 and 13, the same numerals are added to the same portions as FIGS. 1 to 11B.

In this embodiment, each element 141, 142 of the antenna apparatus 10 is constituted by a conductor pattern formed on the circuit substrate 16. An antenna region 54 and a ground conductor region 56 are set on the circuit substrate 16; in the antenna region 54, an insulating plate is exposed on the surface of the circuit substrate 16; and in the ground conductor region 56, a ground conductor 58 is formed on the insulating plate. The conductive patterns of the elements 141, 142 are formed on the antenna region 54. Therefore, in the antenna apparatus 10, as shown in FIG. 13, an insulating space d is established between the element 141, 142 disposed on the antenna region 54 and the ground conductor 58, and interferences can be avoided between the ground conductor 58 and the element 141, 142.

In this way, even when using the passive element 14 composed of the elements 141, 142 formed on the circuit substrate 16, the passive element 14 can be coupled to the main antenna 12 and, as is the case with the aforementioned embodiment, the resonance can be achieved at the resonance frequency f1 of the elements 141, 142, for example, 800 [MHz] by making the PIN diode 18 conductive or at the resonance frequency f2 of the element 141 only, for example, 2 [GHz] by making the PIN diode 18 nonconductive, in accordance with the presence and absence of the voltage VC applied to the voltage application terminal 24, to switch two operating frequencies.

Fourth Embodiment

Figure 14:
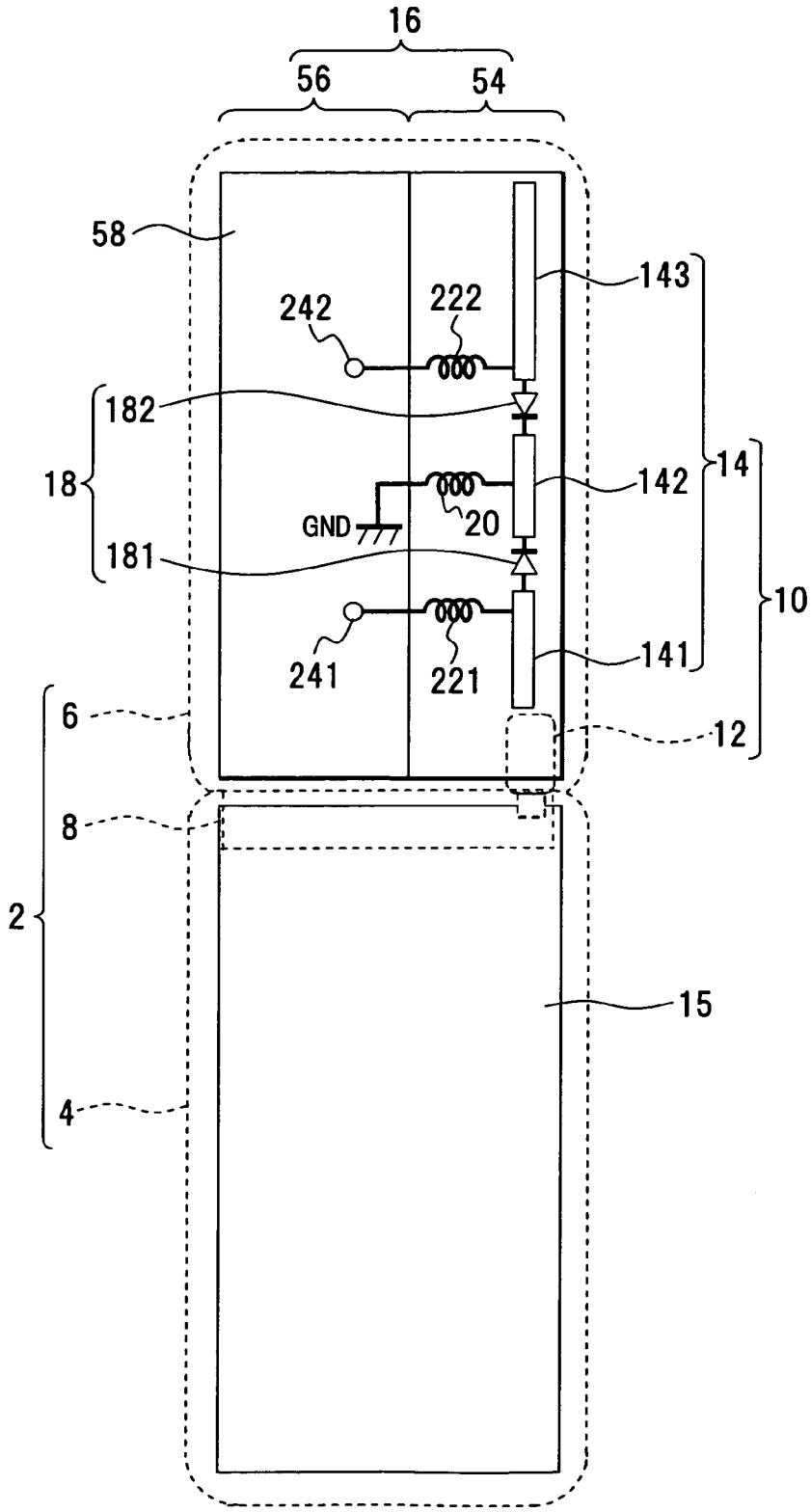
FIG. 14 shows a configuration example of a passive element of a cellular phone according to a fourth embodiment.

A fourth embodiment of the present invention will be described with reference to FIG. 14. FIG. 14 shows a configuration example of a passive element of a cellular phone. In FIG. 14, the same numerals are added to the same portions as FIGS. 1 to 13.

In this embodiment, as is the case with the third embodiment, the antenna region 54 and the ground conductor region 56 are set on the circuit substrate 16 and three elements 141, 142, 143 are formed by conductor patterns as a plurality of element units constituting the passive element 14 in the antenna region 54. A PIN diode 181 is connected between the element 141 and the element 142; a PIN diode 182 is connected between the element 142 and the element 143; and the cathode of each PIN diode 181, 182 is connected to the element 142. The element 142 is connected via the choke coil 20 to the ground point; a first voltage application terminal 241 is formed via a choke coil 221 for the element 141; and a second voltage application terminal 242 is formed via a choke coil 222 for the element 143. The elements 141 to 143, the PIN diodes 181, 182, and the choke coils 20, 221, 222 are mounted on the circuit substrate 16.

With such a configuration, when the voltage VC is applied to the voltage application terminals 241 and 242, the both PIN diodes 181, 182 become conductive; all the elements 141 to 143 are serially connected; and if a resonance frequency f1 of a element length of the passive element 14 composed of the elements 141 to 143 is resonated at $\lambda/2$ of 800 [MHz], the operating frequency is 800 [MHz].

When the voltage VC is applied only to the voltage application terminal 241 to make the PIN diode 181 conductive, the elements 141, 142 are connected, and if a resonance frequency f2 (>f1) of a element length of the passive element 14 composed of the elements 141, 142 is resonated at λ/2 of 1.7 [GHz], the operating frequency is 1.7 [GHz].

When the both voltage application terminals 241, 242 are set to 0 [V], the both PIN diodes 181, 182 become nonconductive; the elements 141, 142, 143 are disconnected, i.e., become independent; only the element 141 is connected to the main antenna 12; and if a resonance frequency f3 (>f2>f1) of the element 141 is resonated at λ/2 of 2 [GHz], the operating frequency is 2 [GHz].

Although the passive element 14 is constituted by three elements in this embodiment, the passive element 14 may be constituted by four or more elements.

Fifth Embodiment

Figure 15:
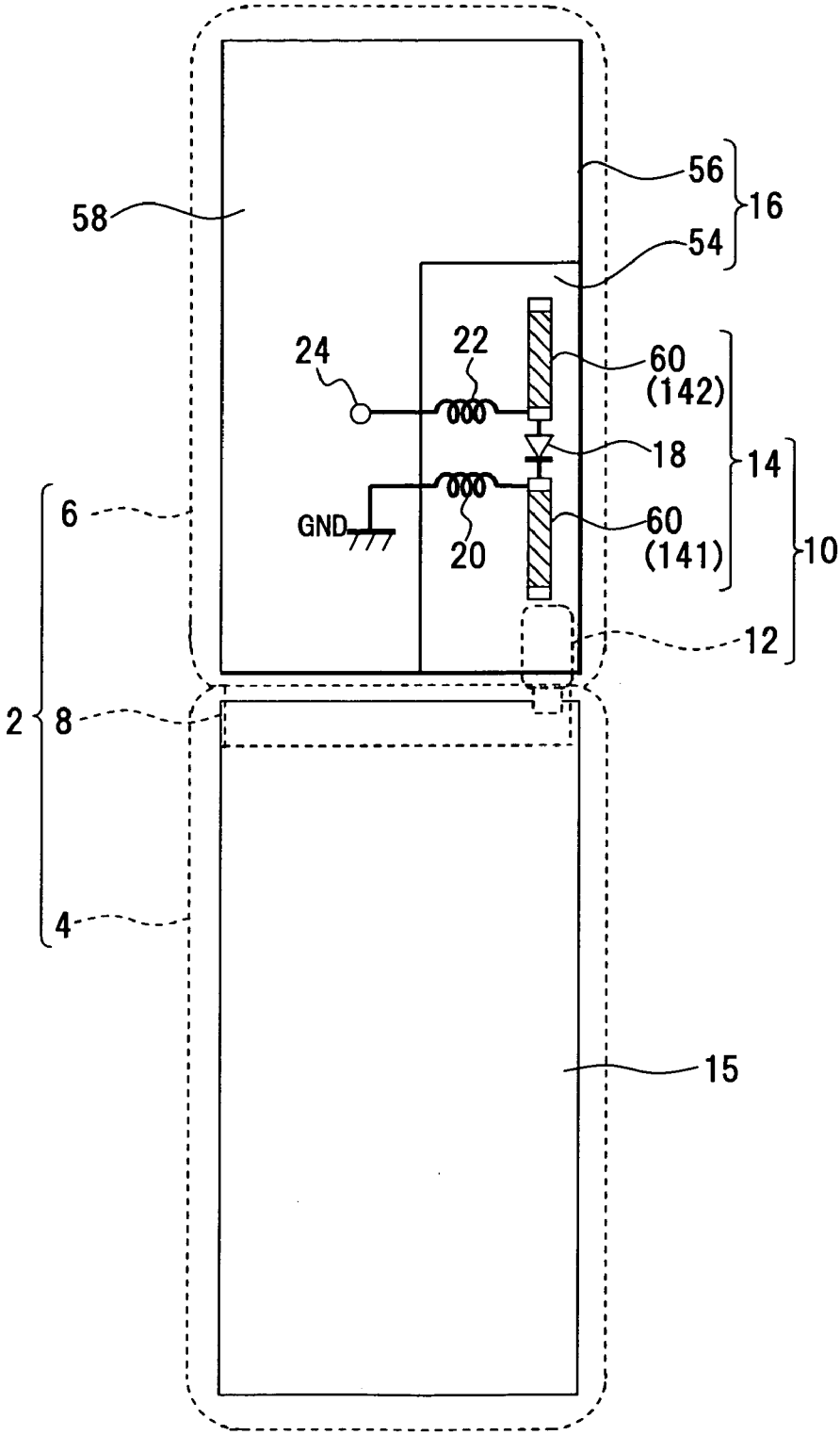
FIG. 15 shows a configuration example of a passive element of a cellular phone according to a fifth embodiment.
Figure 16:
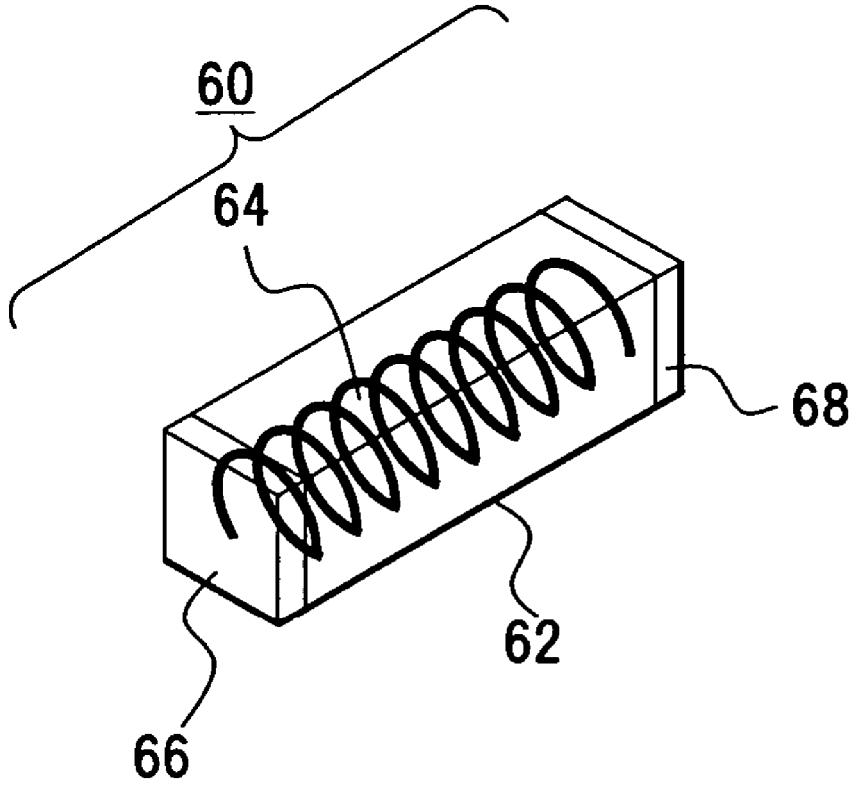
FIG. 16 shows an example of a chip antenna element used for the passive element.

A fifth embodiment of the present invention will be described with reference to FIGS. 15 and 16. FIG. 15 shows a configuration example of a passive element of a cellular phone and FIG. 16 shows an example of a chip antenna element used for the passive element. In FIGS. 15 and 16, the same numerals are added to the same portions as FIGS. 1 to 14.

In this embodiment, the ground conductor 58 is formed at the ground conductor region 56 on the surface portion of the circuit substrate 16, and the antenna region 54 is formed by exposing the insulating plate of the circuit substrate 16. In this case, the antenna region 54 is formed in proximity to the main antenna 12. This antenna region 54 is provided with the passive element 14 and, in this embodiment, the elements 141, 142 are constituted by chip antenna elements 60. As shown in FIG. 16, a coil 64 made of a conductive material is disposed within a dielectric 62 made of a high dielectric material, and electrodes 66, 68 are formed at the ends of the coil 64. The chip antenna element 60 is an example and is not limited to such a form.

The elements 141, 142 composed of the chip antenna elements 60 are away from each other when disposed; the PIN diode 18 is mounted in the space therebetween; and a serial circuit is constituted by the two chip antenna elements 60 constituting the elements 141, 142 and the PIN diode 18 therebetween. The cathode of the PIN diode 18 is grounded via the choke coil 20, and the voltage application terminal 24 is formed via the choke coil 22 for the anode of the PIN diode 18.

In the case of the passive element 14 using such chip antenna element 60 for the elements 141 and 142, the passive element 14 can be coupled to the main antenna 12 and, as is the case with the aforementioned embodiment, the resonance can be achieved at the resonance frequency f1 of the elements 141, 142, for example, 800 [MHz] by making the PIN diode 18 conductive or at the resonance frequency f2 of the element 141 only, for example, 2 [GHz] by making the PIN diode 18 nonconductive, in accordance with the presence and absence of the voltage VC applied to the voltage application terminal 24, to switch two operating frequencies.

When the chip antenna elements 60 are used for the elements 141, 142, since the chip antenna elements 60 are antenna elements using a high dielectric material, the passive element 14 can be miniaturized to reduce the area of the passive element 14 on the circuit substrate 16, which contributes to the miniaturization of the radio communication apparatus such as the cellular phone 2 to which the antenna apparatus 10 is mounted.

Sixth Embodiment

Figure 17:
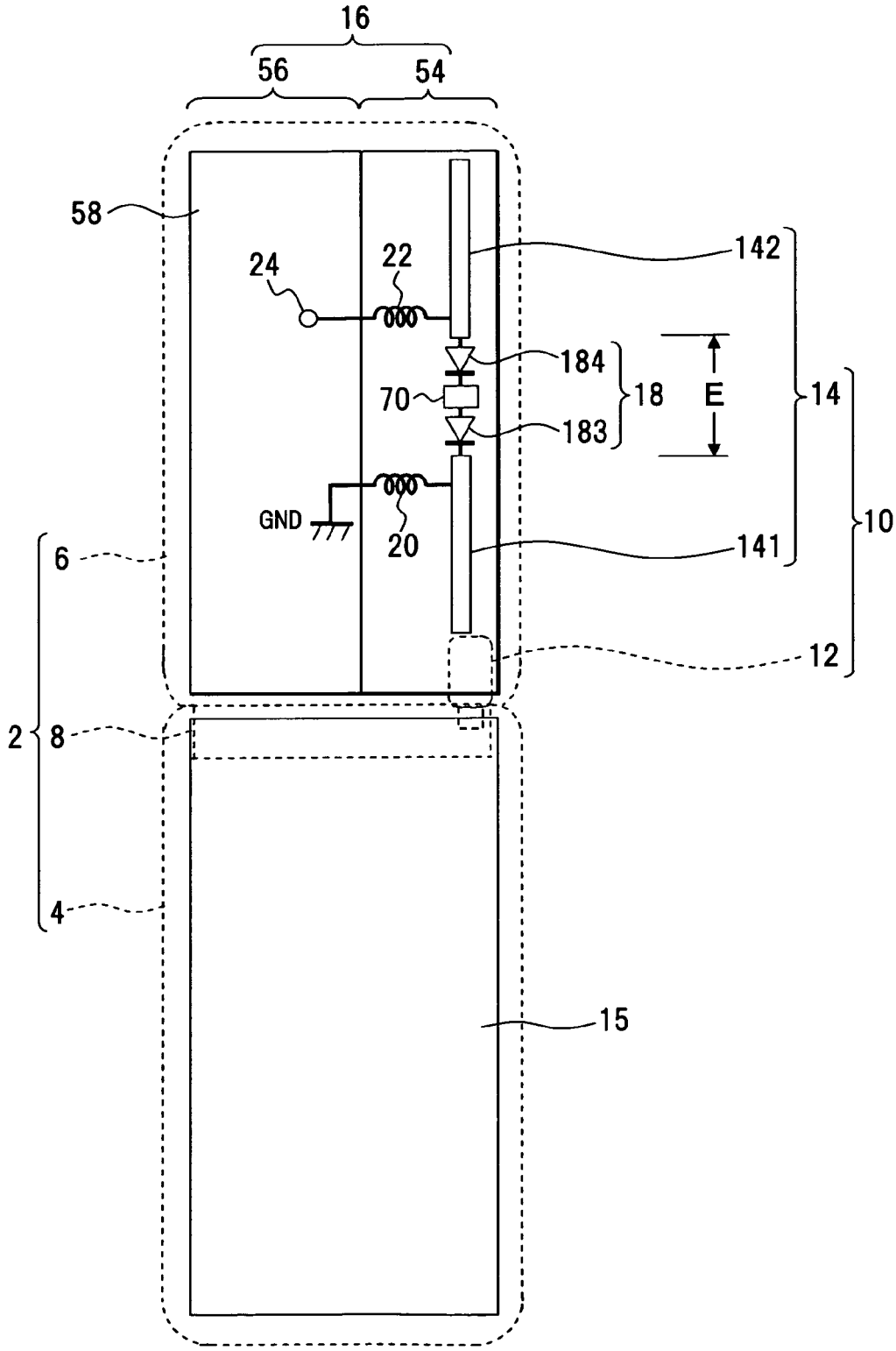
FIG. 17 shows a configuration example of a passive element of a cellular phone according to a sixth embodiment.

A sixth embodiment of the present invention will be described with reference to FIG. 17. FIG. 17 shows a configuration example of a passive element of a cellular phone. In FIG. 17, the same numerals are added to the same portions as FIGS. 1 to 16.

In this embodiment, a predetermined space E is established between the elements 141 and 142 disposed in the antenna region 54 of the circuit substrate 16 and, within this space E, PIN diodes 183, 184 are disposed as means for setting an insulating space, along with a connecting unit 70 of the PIN diodes 183, 184. Each PIN diode 183, 184 is connected in the forward direction from the element 142 to the element 141 to constitute a serial circuit of the element 141, the PIN diode 183, the connecting unit 70, the PIN diode 184, and the element 142; the cathode of the PIN diode 183 is grounded via the choke coil 20; and the anode of the PIN diode 184 is connected via the choke coil 22 to the voltage application terminal 24.

In such a configuration, when a sufficient distance is established between the elements 141, 142, if the PIN diodes 183, 184 are made nonconductive to couple the main antenna 12 only to the element 141 that is the passive element 14, the element 141 and the element 142 are prevented from being coupled together with electromagnetic waves. Since the distance is established between the elements 141, 142 to prevent the coupling in this way, deteriorating the operation performance of the element 141 by the element 142 is prevented; for example, the deterioration of the radiant efficiency can be prevented at the high-range operating frequency f2, for example, 2 [GHz]; and an higher efficiency can be achieved in the antenna apparatus 10.

Other Embodiments

Other embodiments of the present invention are listed as follows.

(1) Configuration of Passive Element 14

Figure 18:
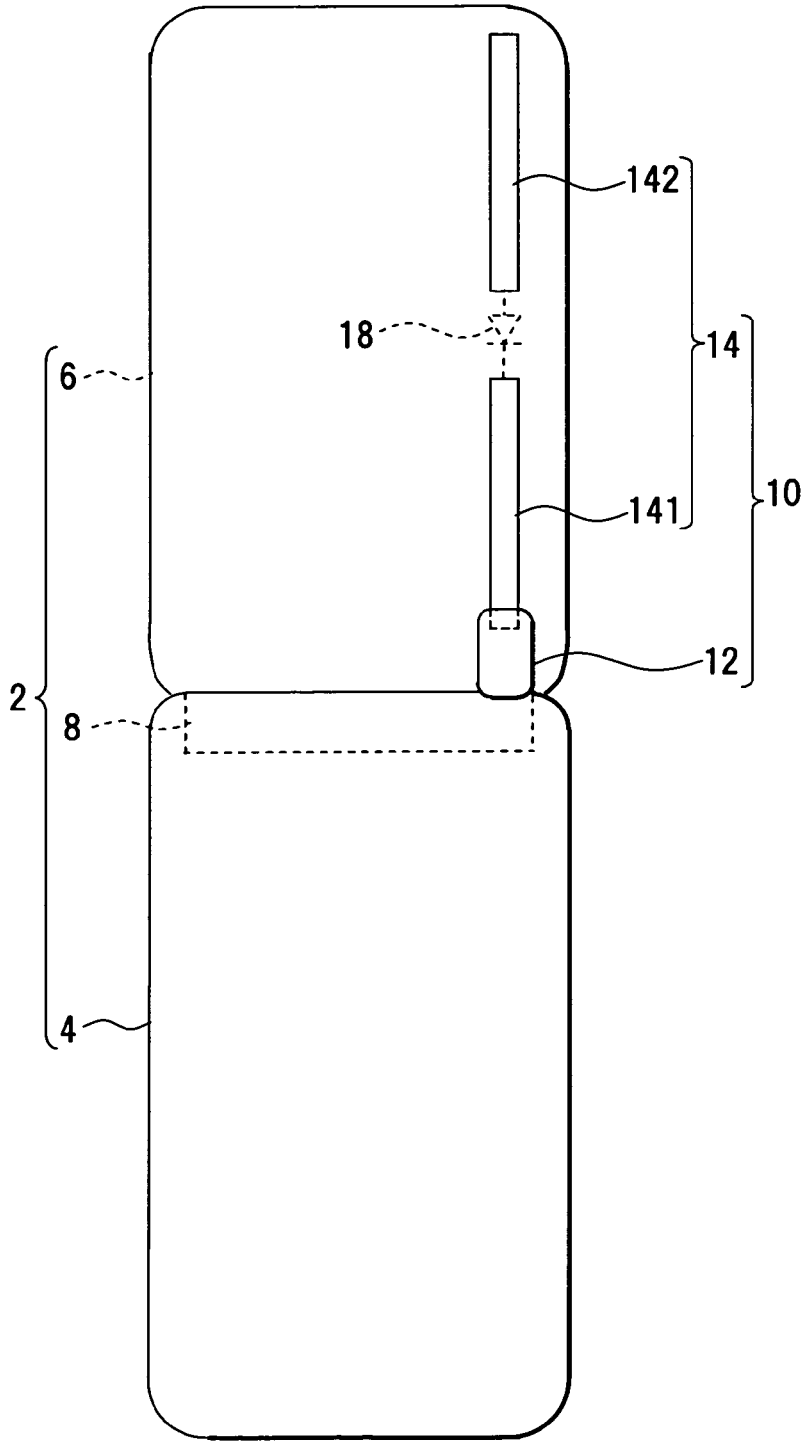
FIG. 18 shows another configuration example of the passive element of the cellular phone.

Each element 141, 142 of the passive element 14 may be made of a conducting plate such as a metal plate. As shown in FIG. 18, each element 141, 142 may be disposed in the casing unit 6 by conductor printing or by embedding a conductor and may be exposed to the outside of the casing unit 6. In this case, the PIN diode 18 may be disposed within the exterior member constituting the casing unit 6 or on the inner face of the casing unit 6.

(2) Switch-Over of Connection of Elements 141, 142

Figure 19:
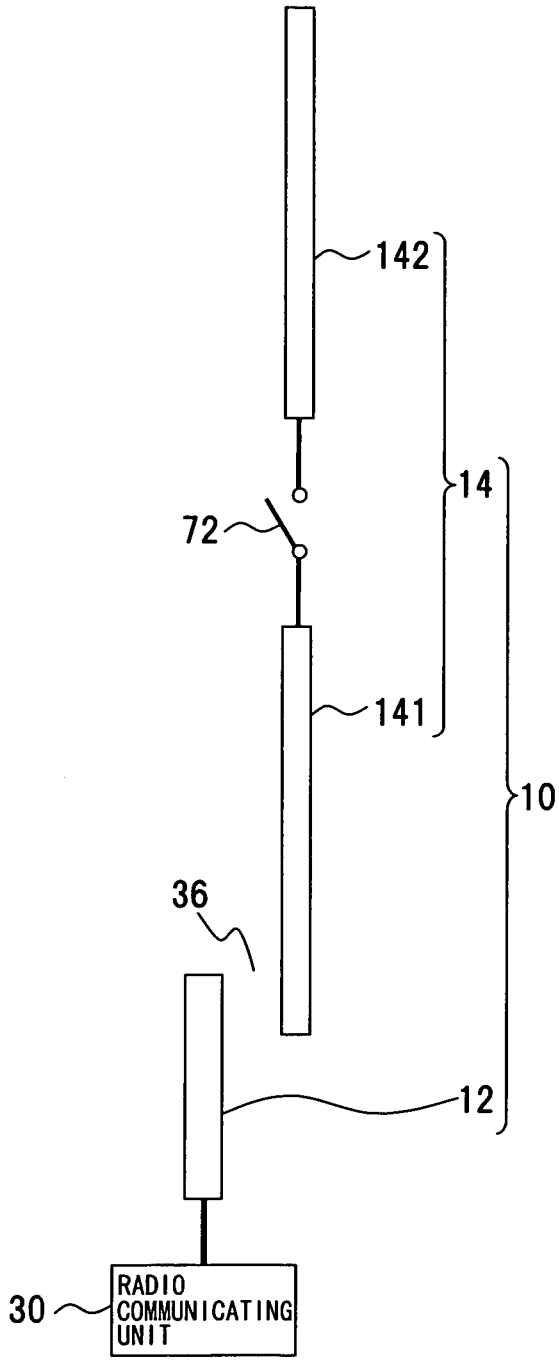
FIG. 19 shows another configuration example of the passive element of the cellular phone.

Although the PIN diode 18 is used for the switching element in the above embodiments, the connection may be switched by using a mechanical contact 72 as shown in FIG. 19.

Figure 20:
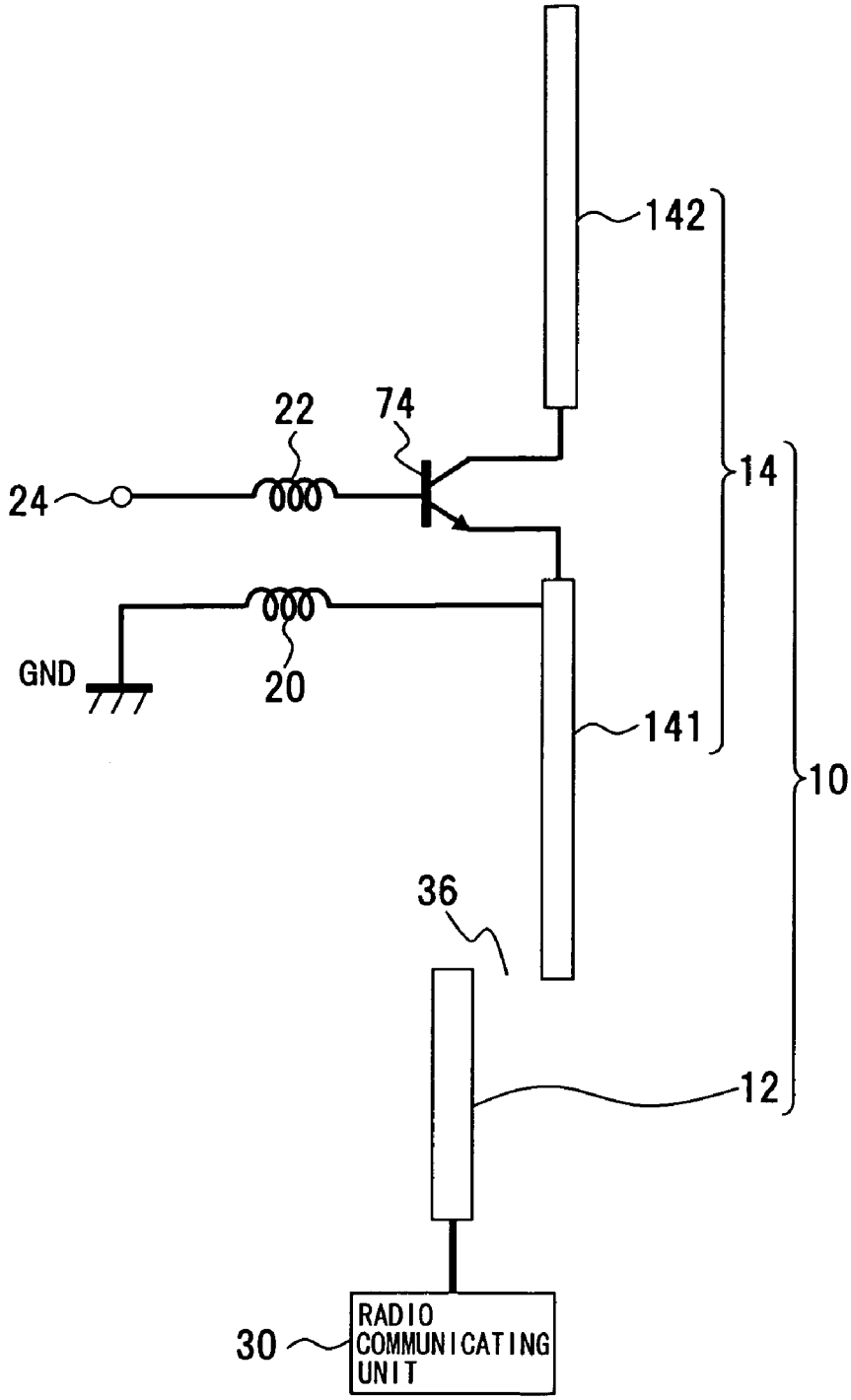
FIG. 20 shows another configuration example of the passive element of the cellular phone.
Figure 21:
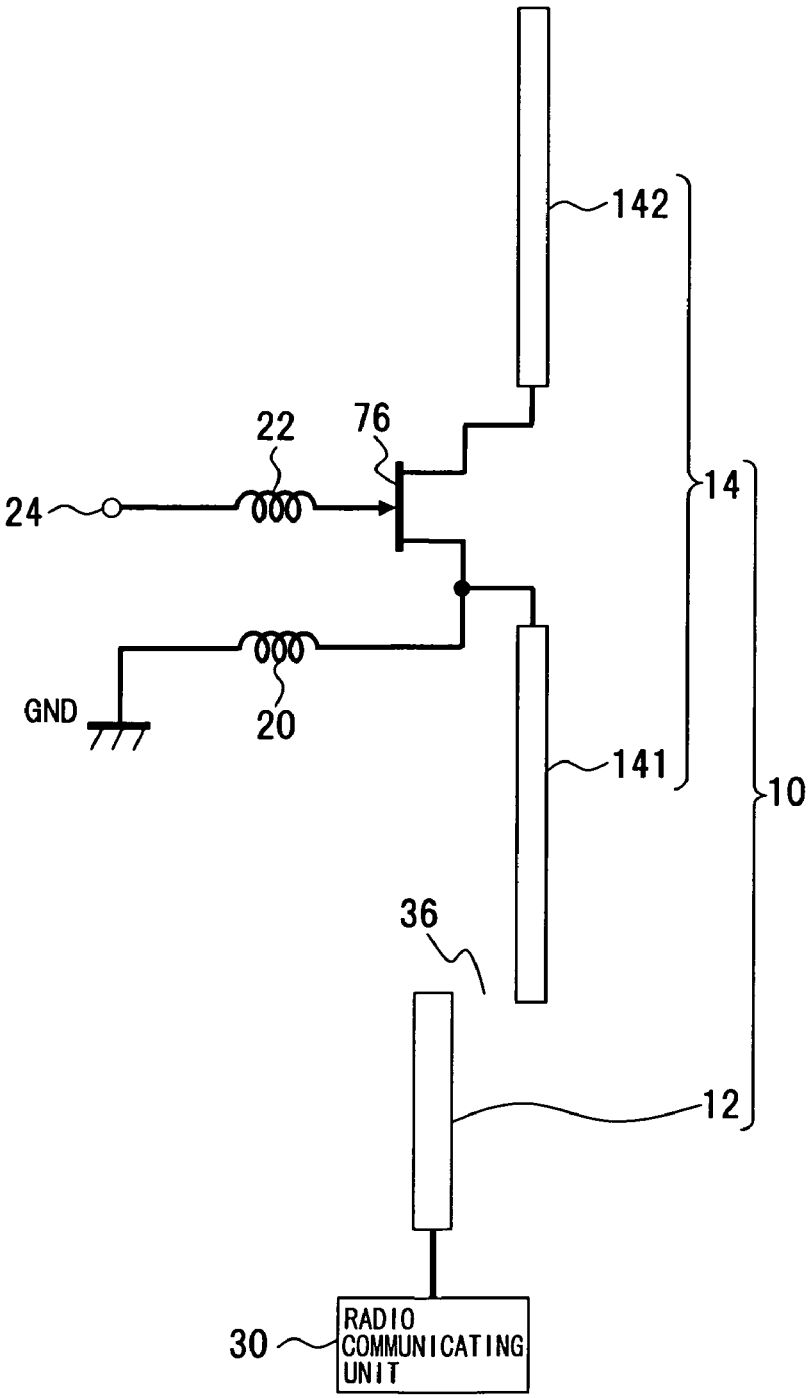
FIG. 21 shows another configuration example of the passive element of the cellular phone.

As shown in FIG. 20, a transistor 74 may be used for the switching element or, as shown in FIG. 21, a field-effect transistor (FET) 76 may be used. Other semiconductor devices may be used.

(3) Radio Communication Apparatus

Figure 22:
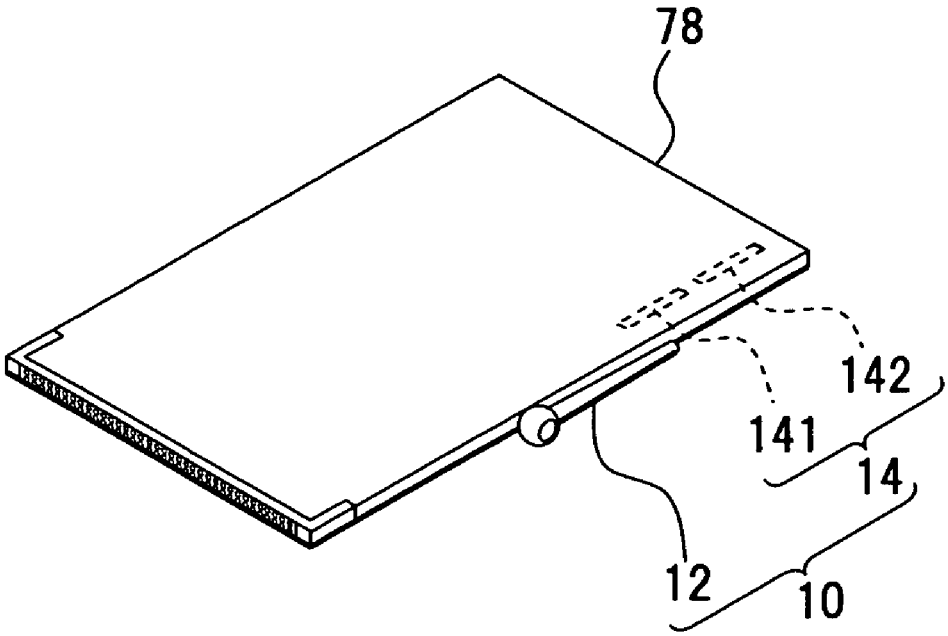
FIG. 22 shows another configuration example of the radio communication apparatus.

Although the cellular phone 2 is illustrated as the radio communication apparatus in the above embodiments, the present invention may be applied to a communication card 78 adding a communication function to various electronic devices as shown in FIG. 22.

Figure 23:
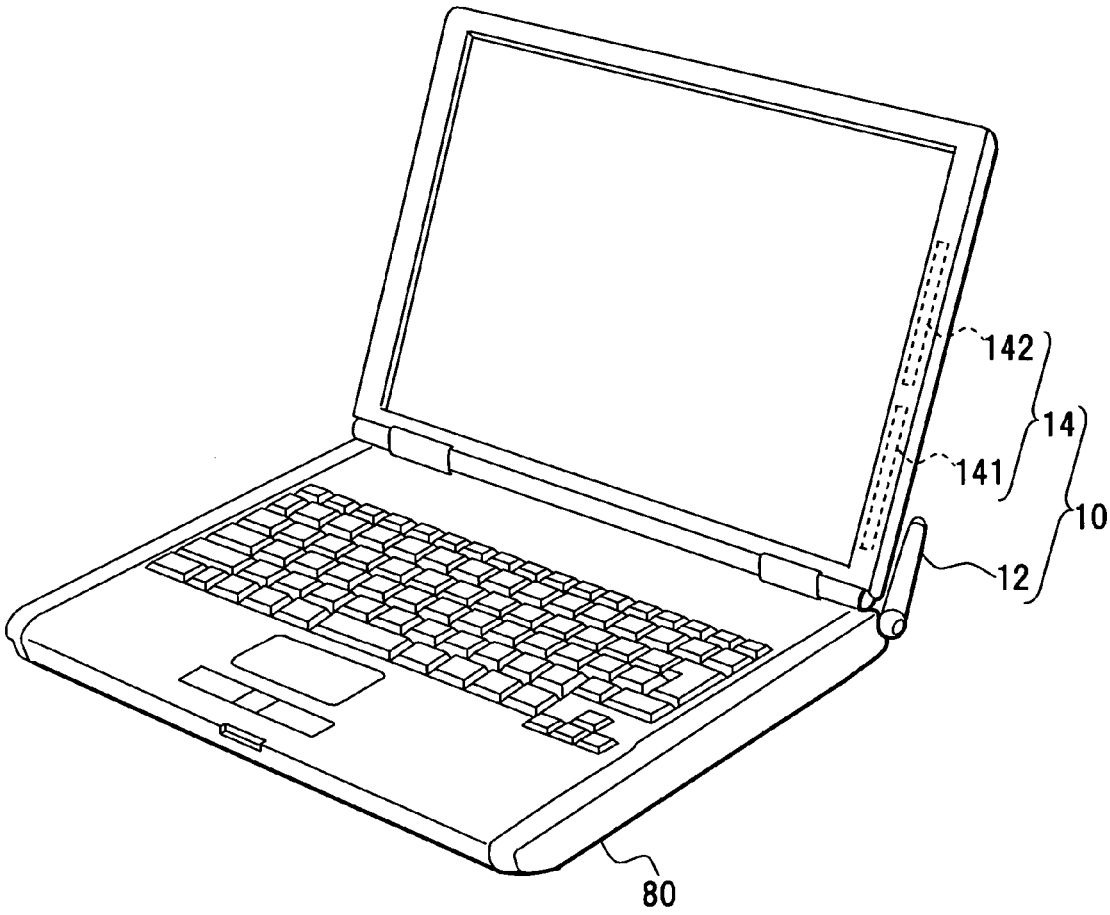
FIG. 23 shows another configuration example of the radio communication apparatus.

As shown in FIG. 23, the passive element 14 may be built into a personal computer (PC) 80 including a communication function to support a plurality of radio frequencies.

(4) Cellular Phone 2

Although the folding cellular phone 2 is illustrated in the above embodiments, the present invention may be applied to a cellular phone in the form of elongating/contracting an apparatus length by sliding the casing unit 6 relative to the casing unit 4 and a cellular phone or radio communication apparatus composed of a single casing unit and is not limited to the above embodiments.

Although the presently preferred embodiments of the present invention have been set forth hereinabove, it is to be appreciated that the present invention is not limited to the above description, that various modifications and alterations can naturally be achieved by those who skilled in the art based on the gist of the present invention as defined in the claims or disclosed in the specification, and that such modifications and alterations are obviously included within the scope of the present invention.

The present invention relates to an antenna corresponding to a plurality of radio communication frequencies and is useful because the present invention can support a plurality of radio communication frequencies by switching the element units of the passive element, can prevent the effect of a human body on the radiated electromagnetic waves, and can be used with various radio communication apparatus using a plurality of radio communication frequencies.

What is claimed is:

1. An antenna apparatus comprising:

a non-feeding element having a plurality of element units, the non-feeding element at its one end being disposed in proximity to a feeding element; and a switching element linking the element units of the non-feeding element, wherein an operating frequency and a radiation pattern of the non-feeding element are switched by opening and closing the switching element.

2. The antenna apparatus of claim 1, wherein the non-feeding element is disposed toward the end of the feeding element to constitute a waveguide element by coupling with the feeding element.

3. The antenna apparatus of claim 1, wherein the non-feeding element includes a control terminal that applies a control signal for opening and closing the switching element.

4. The antenna apparatus of claim 1, comprising:

a control terminal that applies a control signal for opening and closing the switching element; and an inductor that is inserted between the control terminal and the non-feeding element.

5. The antenna apparatus of claim 1, wherein a ground conductor plate is disposed toward the non-radiation surface for the non-feeding element.

6. The antenna apparatus of claim 1, wherein the element units of the non-feeding element are connected to a circuit substrate via elastic contacts.

7. A radio communication apparatus comprising:

a non-feeding element having a plurality of element units, the non-feeding element at its one end being disposed in proximity to a feeding element; and a switching element linking the element units of the non-feeding element, wherein an operating frequency and a radiation pattern of the non-feeding element are switched by opening and closing the switching element.

8. The radio communication apparatus of claim 7, comprising:

a control terminal that applies a control signal for opening and closing the switching element; and a controlling unit that applies the control signal to the control terminal to perform control for making the switching element conductive or nonconductive.

9. The radio communication apparatus of claim 7, comprising:

a control terminal that applies a control signal for opening and closing the switching element; and an inductor that is inserted between the control terminal and the non-feeding element.

10. The radio communication apparatus of claim 7, wherein the non-feeding element includes a element unit grounded.

11. The radio communication apparatus of claim 7, wherein the non-feeding element is constituted by a plurality of conductor patterns formed on a circuit substrate.

12. The radio communication apparatus of claim 7, wherein the non-feeding element is divided into a plurality of the element units and is formed by linking each element unit with the switching element.

13. The radio communication apparatus of claim 7, wherein the non-feeding element is provided with a predetermined space for including a ground conductor.

14. The radio communication apparatus of claim 7, wherein a ground conductor plate is disposed toward the non-radiation surface for the non-feeding element.

15. The radio communication apparatus of claim 14, wherein the ground conductor plate is a casing unit of the radio communication apparatus or a circuit substrate built into the radio communication apparatus.

16. The radio communication apparatus of claim 7, wherein the switching element is a semiconductor device.

17. The radio communication apparatus of claim 7, wherein the non-feeding element is a chip antenna.

18. The radio communication apparatus of claim 7, wherein the element units of the non-feeding element are connected to the circuit substrate via elastic contacts.

19. The radio communication apparatus of claim 7, wherein the non-feeding element is formed by establishing the predetermined space between the element units and by inserting a semiconductor device for linking the element units in each space.

* * * * *